US006471373B1

(12) United States Patent
Phillips

(10) Patent No.: US 6,471,373 B1
(45) Date of Patent: Oct. 29, 2002

(54) EMERGENCY STROBE LIGHT SYSTEM

(76) Inventor: Charles Phillips, 851 Springfield Ave. #22, Summit, NJ (US) 07901

( * ) Notice: Subject to any disclaimer, the term of this patent is extended or adjusted under 35 U.S.C. 154(b) by 0 days.

(21) Appl. No.: 09/678,283

(22) Filed: Sep. 30, 2000

Related U.S. Application Data

(60) Provisional application No. 60/158,191, filed on Oct. 7, 1999.

(51) Int. Cl.[7] ..... G08B 5/00

(52) U.S. Cl. ..... 362/276; 362/397; 362/253; 379/37; 379/45; 340/332; 340/693.9

(58) Field of Search ..... 362/253, 145, 362/276, 802, 397, 125; 379/37, 45, 38; 340/332, 326, 693.9

(56) References Cited

U.S. PATENT DOCUMENTS 5,636,263 A * 6/1997 Thomson ..... 379/45
5,748,706 A * 5/1998 Morgan et al. ..... 379/37
5,831,522 A * 11/1998 Weed et al. ..... 340/473
5,838,771 A * 11/1998 Moeller ..... 379/45
5,880,672 A * 3/1999 Weaver ..... 340/332
5,960,061 A * 9/1999 Fahie et al. ..... 379/37
5,991,363 A * 11/1999 Thomson ..... 379/45
6,205,203 B1 * 3/2001 Gorman et al. ..... 379/37
6,289,082 B1 * 9/2001 Scheiding ..... 379/37
6,307,920 B1 * 10/2001 Thomson et al. ..... 379/45

* cited by examiner

*Primary Examiner*—Thomas M. Sember
(74) *Attorney, Agent, or Firm*—Goldstein & Lavas, P.C.

(57) ABSTRACT

An emergency strobe light system including a main housing and one or more telephone interfaces. The rear wall has a The telephone interface has a telephone jack disposed therein, a DTMF decoder, and an RF transmitter. The main housing has an RF receiver, and a strobe light secured to the front wall of the main housing. Suction cups on the front wall of the housing facilitate securement to the front window of a dwelling. When the dialing of an emergency number has been detected by one of the telephone interfaces, and RF signal is transmitted. Once the RF signal is detected, the strobe will flash to alert rescue personnel until disabled by a reset button or disabled by an internal timer following the lapse of a predetermined time period.

4 Claims, 3 Drawing Sheets

EMERGENCY STROBE LIGHT SYSTEM

CROSS REFERENCES AND RELATED SUBJECT MATTER

This application relates to subject matter contained in provisional patent application Ser. No. 60/158,191, filed in the United States Patent Office on Oct. 7, 1999.

BACKGROUND OF THE INVENTION

The present invention relates to an emergency strobe light system and more particularly pertains to illuminating once a person telephones for assistance to alert emergency assistance workers as to a precise location.

The advances in emergency responses to various medical, police, and fire emergencies has been dramatic over the years. Usually, it only takes moments for an operator receiving a "911" call to be able to accurately locate the person who is placing the emergency call. This provides the emergency response team with an address to be able to rush to in order to provide assistance.

Once the response team nears the address at which the request for assistance originated, the responding personnel is usually forced to proceed at a very deliberate pace in order to locate the exact street address. Particularly at night, the task of finding a particular house along a dark street is often inordinately difficult. Emergency personnel responding to a call are often forced to proceed at a crawl along the street searching for a particular number, with the aid of a searchlight when at night. It is awkward for emergency vehicles such as ambulances or fire engines to back-up and therefore, rather than risk passing by the desired house number, the drivers proceed with excessive caution while attempting to find the desired address.

What is needed is a system that will indicate to emergency personnel the precise location of the person who has made the emergency call automatically without requiring the person in need of assistance to do anything in addition to making the emergency phone call.

The present invention attempts to solve the abovementioned problem by providing a system that is in communication with an existing telephone line so that when a person dials "911", a strobe light that would be attached to an outwardly facing window will be activated that can easily be seen by emergency personnel once in the area.

The use of emergency alerting systems is known in the prior art. More specifically, emergency alerting systems heretofore devised and utilized for the purpose of allowing those in need of assistance to be easily reached are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,748,706 to Morgan discloses an emergency signaling strobe light that is attachable to an area to provide optimum viewing, and is activated by an RF transmitter when an emergency telephone number such as "911", is dialed. U.S. Pat. No. 4,993,058 to McGinn and 5,012,507 to Leighton disclose additional emergency strobe systems activated by dialing "911" on a telephone.

While these devices fulfill their respective, particular objective and requirements, the aforementioned patents do not describe an emergency strobe light system for illuminating once a person telephones for assistance to alert emergency assistance workers as to a precise location.

In this respect, the emergency strobe light system according to the present invention substantially departs from the conventional concepts and designs of the prior art, and in doing so provides an apparatus primarily developed for the purpose of illuminating once a person telephones for assistance to alert emergency assistance workers as to a precise location.

Therefore, it can be appreciated that there exists a continuing need for a new and improved emergency strobe light system which can be used for illuminating once a person telephones for assistance to alert emergency assistance workers as to a precise location. In this regard, the present invention substantially fulfills this need.

SUMMARY OF THE INVENTION

In the view of the foregoing disadvantages inherent in the known types of emergency alerting systems now present in the prior art, the present invention provides an improved emergency strobe light system. As such, the general purpose of the present invention, which will be described subsequently in greater detail, is to provide a new and improved emergency strobe light system and method which has all the advantages of the prior art and none of the disadvantages.

To attain this, the present invention essentially comprises a main housing having a power cord extending outwardly from the rear wall thereof for coupling with a standard electrical outlet. The rear wall has a power light disposed therein in communication with the power cord. A telephone interface has a telephone jack disposed therein, a DTMF decoder, and an RF transmitter. The main housing has an RF receiver, and a strobe light secured to the front wall of the main housing. A reset button extends from the housing, and is in communication with the strobe for selectively manually disabling the strobe. Once an RF signal from one of the telephone interfaces is detected, the strobe will flash to alert rescue personnel until disabled by the reset button or disabled by an internal timer following the lapse of a predetermined time period. A plurality of suction cups are secured to the front wall of the housing in a spaced relationship so as not to impede the strobe light.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved emergency strobe light system which has all the advantages of the prior art emergency alerting systems and none of the disadvantages.

It is another object of the present invention to provide a new and improved emergency strobe light system which may be easily and efficiently manufactured and marketed.

It is a further object of the present invention to provide a new and improved emergency strobe light system which is of durable and reliable construction.

An even further object of the present invention is to provide a new and improved emergency strobe light system which is susceptible of a low cost of manufacture with regard to both materials and labor, and which accordingly is then susceptible of low prices of sale to the consuming public, thereby making such an emergency strobe light system economically available to the buying public.

Even still another object of the present invention is to provide a new and improved emergency strobe light system for illuminating once a person telephones for assistance to alert emergency assistance workers as to a precise location.

Lastly, it is an object of the present invention to provide a new and improved emergency strobe light system including a main housing having a power cord extending outwardly from the rear wall thereof for coupling with a standard electrical outlet.

The rear wall has a power light disposed therein in communication with the power cord. A telephone interface has a telephone jack disposed therein, a DTMF decoder, and an RF transmitter. The main housing has an RF receiver, and a strobe light secured to the front wall of the main housing. A reset button extends from the housing, and is in communication with the strobe for selectively manually disabling the strobe. Once an RF signal from one of the telephone interfaces is detected, the strobe will flash to alert rescue personnel until disabled by the reset button or disabled by an internal timer following the lapse of a predetermined time period. A plurality of suction cups are secured to the front wall of the housing in a spaced relationship so as not to impede the strobe light.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
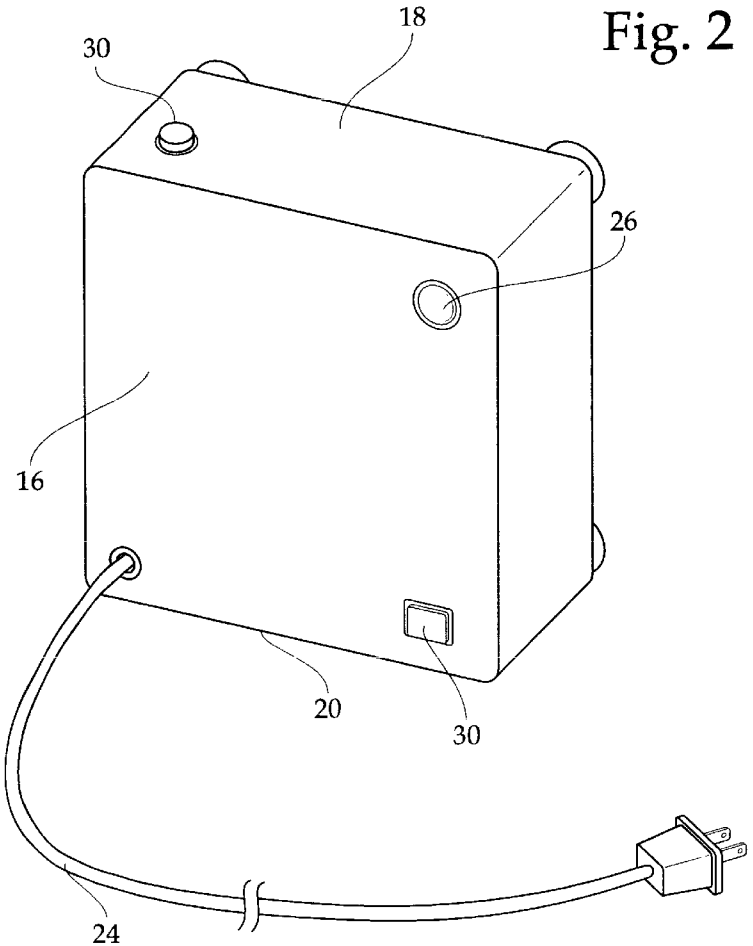
FIG. 2 is a rear perspective view of the present invention.
Figure 1:
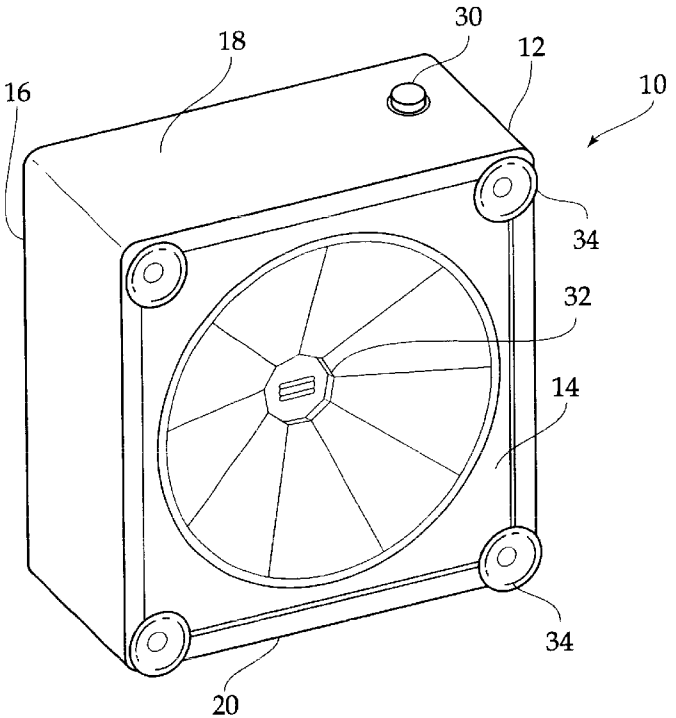
FIG. 1 is a perspective view of the preferred embodiment of window portion of the emergency strobe light system contained within a main housing and constructed in accordance with the principles of the present invention.
Figure 3:
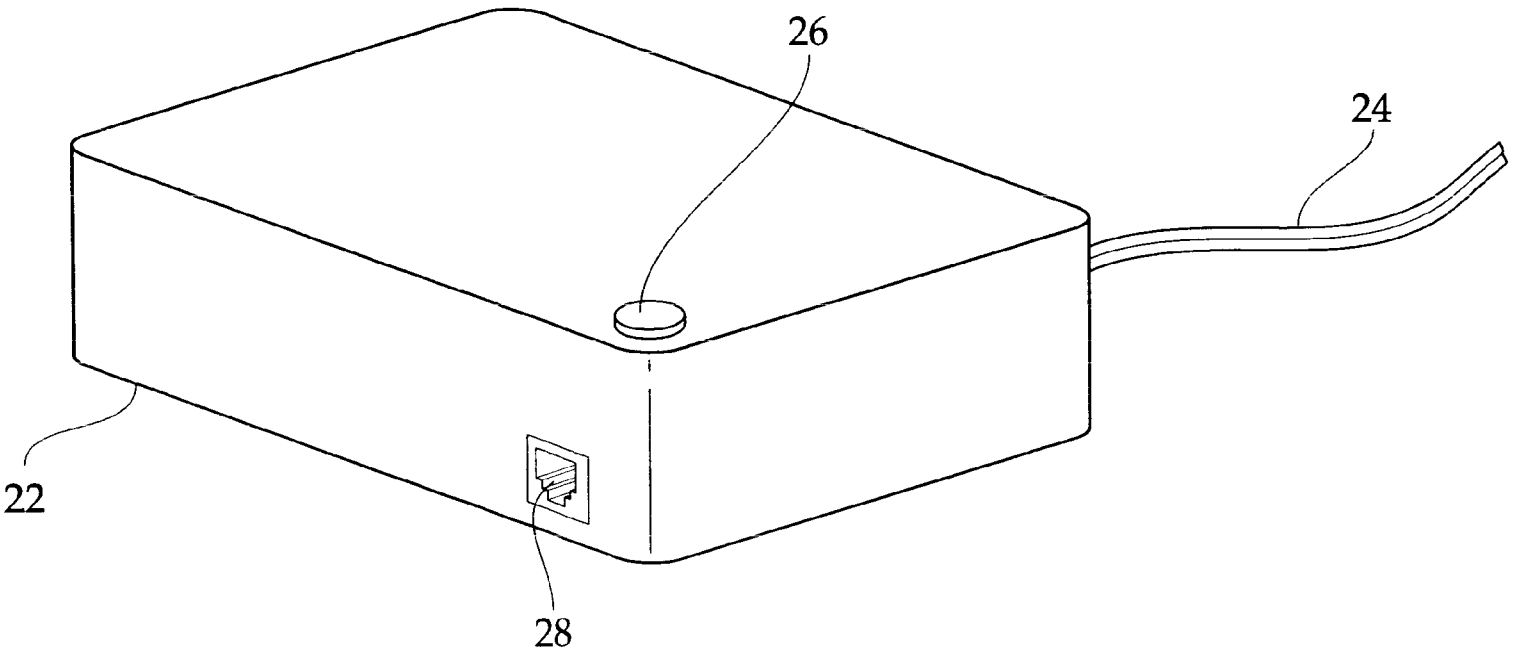
FIG. 3 is a perspective view one of the telephone interfaces according to the present invention, illustrating the phone jack thereof.

With reference now to the drawings, and in particular, to FIGS. 1 through 3 thereof, the preferred embodiment of the new and improved emergency strobe light system embodying the principles and concepts of the present invention and generally designated by the reference number 10 will be described.

Specifically, it will be noted in the various Figures that the device relates to a emergency strobe light system for illuminating once a person telephones for assistance to alert emergency assistance workers as to a precise location. In its broadest context, the device consists of window unit having a main housing, a strobe light, and a plurality of suction cups, a telephone interface connects to each telephone within a dwelling and transmits a signal to the window unit upon detection that an emergency telephone number was dialed at its associated telephone. Such components are individually configured and correlated with respect to each other so as to attain the desired objective.

A main housing 12 has a generally square configuration defined by a front wall 14, a rear wall 16, a top wall 18, a bottom wall 20, and opposed side walls. The main housing 12 is preferable small, with a length of the top, bottom, and side walls being about five inches, and is also known as a window unit, since it is mounted to, or immediately adjacent to a front window of a dwelling during ordinary usage thereof. The housing 12 has a power cord 24 extending outwardly from the rear wall thereof for coupling with a standard electrical outlet so as to provide power to the device 10. Alternately, an internal battery could be utilized to power the device 10. The rear wall has a power light 26 disposed therein in communication with the power cord 24. When lit, the power light 26 will indicate that the device 10 is properly powered.

Referring to FIG. 3, a telephone interface 22 has a telephone jack 28 for connecting to a telephone within the dwelling. Preferably one telephone interface 22 is provided for each of the telephones in the dwelling. The telephone interface 22 is configured so that once an emergency telephone number such as "911" or another preprogrammed number is dialed on the telephone that is connected with the telephone interface 22, an RF signal will be transmitted to the window unit, which will enable the strobe light in a manner which will be disclosed hereinafter.

The strobe light 32 is secured to the front wall 14 of the main housing 12. As previously discussed, a primary goal of the device is that the strobe light 32 is activated once a "911" call has been placed. A reset button 30 is provided at the main housing 12 or window unit 12 to manually deactivate the strobe light 32. The strobe light 32 is preferably provided with reflector shields so as to intensify the light 32 for easier viewing from outside the dwelling.

A plurality of suction cups 34 are secured to the front wall 14 of the housing 12 in a spaced relationship so as not to impede the strobe light 32. The suction cups 34 allow the device 10 to be attached to a front window of a dwelling so that the strobe light 32 is directed outwardly of said front window in order to be seen by rescue personnel responding to the emergency call.

Figure 4:
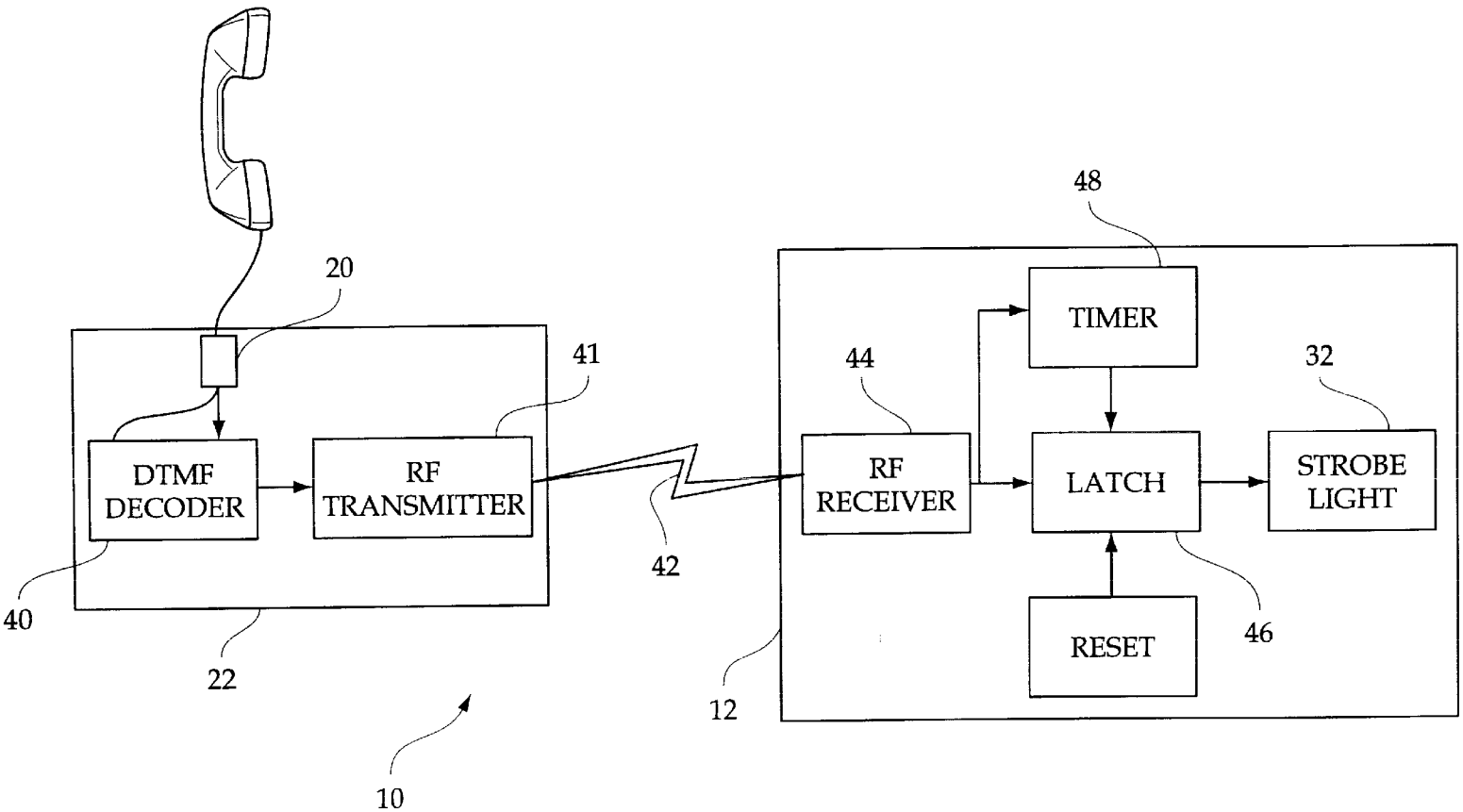
FIG. 4 is a functional block diagram, illustrating major functional components within the main housing of the window portion and the telephone interface according to the present invention.

FIG. 4 depicts functional components of the system 10 which allow it to operate in the manner previously described. In particular, each telephone interface 22 has a DTMF decoder 40 in communication with the telephone jack 28. The DTMF decoder 40 registers DTMF (dual-tone multi-frequency) "touch-tones", and produces an output upon the detection of a suitable pattern. That pattern being an emergency number such as "911" or any other pre-programmed combination. Upon the presence of an output from the DTMF decoder 40, an RF transmitter 41 generates the RF signal 42 which is transmitted with sufficient signal strength so as to reach the window unit 12.

At the window unit 12, an RF receiver 44 detects the RF signal 42 from the telephone interface 22. The RF receiver 44 produces an output which sets a latch 46. The latch 46 activates the strobe light 32 when enabled. In addition, a timer 48 is started when the RF receiver detects the RF signal. The timer 48 operates for a predetermined interval or perhaps 30 minutes. At the end of the predetermined interval, the timer 48 generates a resetting signal, which resets the latch 46, and thus disables the strobe light 32. In addition, if the reset button 30 is pressed, the latch 46 is reset, in turn deactivating the strobe light 32.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An emergency strobe light system, for providing a visual indicator to emergency personnel approaching a dwelling that an emergency call has been placed from the dwelling, said dwelling having one or more telephones and a front window, comprising:

a telephone interface, having a telephone jack for connecting to one of the telephones, a DTMF decoder for determining that an emergency telephone number has been dialed on said telephone connected to the telephone jack, and an RF transmitter, for generating an RF signal upon the determination that an emergency telephone number has been dialed; and a main housing, physically distinct from the telephone interface, the main housing having a front panel, suction cups located on the front panel for attaching to the front window of the dwelling, a strobe light located at the front panel, an RF receiver for detecting the RF signal, and a latch which is enabled upon the detection of the RF signal by the latch, wherein the strobe light is activated when the latch is enabled.

2. The emergency strobe light system as recited in claim 1, further comprising a reset button, for manually resetting the latch and causing the strobe light to be deactivated.

3. The emergency strobe light as recited in claim 2, further comprising a timer, the timer activated by the RF receiver, the timer times for a predetermined interval once activated, and then disables the latch when said predetermined interval ends to deactivate the strobe light.

4. The emergency strobe light as recited in claim 3, comprising more than one telephone interface, such that one telephone interface is connected to each telephone within the dwelling.

* * * * *